US010115313B2

(12) United States Patent
Baek

(10) Patent No.: US 10,115,313 B2
(45) Date of Patent: Oct. 30, 2018

(54) SYSTEM AND METHOD FOR RECOGNIZING SURROUNDING VEHICLE

(71) Applicant: HYUNDAI MOBIS Co., Ltd., Yongin-si, Gyeonggi-do (KR)

(72) Inventor: Song Nam Baek, Seoul (KR)

(73) Assignee: HYUNDAI MOBIS Co., Ltd., Yongin-si (KR)

( * ) Notice: Subject to any disclaimer, the term of this patent is extended or adjusted under 35 U.S.C. 154(b) by 0 days.

(21) Appl. No.: 15/354,057

(22) Filed: Nov. 17, 2016

(65) Prior Publication Data

US 2017/0169711 A1 Jun. 15, 2017

(30) Foreign Application Priority Data

Dec. 14, 2015 (KR) ..... 10-2015-0177846

(51) Int. Cl.

| | |
|---|---|
| ***G08G 1/01*** | (2006.01) |
| ***G08G 1/054*** | (2006.01) |
| ***G08G 1/056*** | (2006.01) |
| ***G08G 1/16*** | (2006.01) |

(52) U.S. Cl.
CPC ..... *G08G 1/167* (2013.01); *G08G 1/163* (2013.01); *G08G 1/166* (2013.01)

(58) Field of Classification Search
CPC ..... G08G 1/167
See application file for complete search history.

(56) References Cited

U.S. PATENT DOCUMENTS

| | | | | |
|---|---|---|---|---|
| 2009/0192710 | A1* | 7/2009 | Eidehall | B62D 15/0265 701/301 |
| 2011/0313665 | A1* | 12/2011 | Lueke | G01S 13/931 701/301 |
| 2012/0323473 | A1* | 12/2012 | Irie | B60W 10/06 701/117 |
| 2013/0261947 | A1* | 10/2013 | Yamashiro | G08G 1/137 701/300 |
| 2016/0075280 | A1* | 3/2016 | Shin | B60W 30/12 348/148 |

* cited by examiner

*Primary Examiner* — Joseph Feild
*Assistant Examiner* — Pameshanand Mahase
(74) *Attorney, Agent, or Firm* — Knobbe Martens Olson & Bear LLP

(57) ABSTRACT

A method for a surrounding vehicle recognition system to recognize a surrounding vehicle includes generating a vehicle map showing coordinates of one or more vehicles surrounding a host vehicle with respect to a current location of the host vehicle based on path information of the host vehicle and the surrounding vehicles, generating lane information on the vehicle map based on the current location and radius-of-curvature information of the host vehicle and the path information of the host vehicle and the surrounding vehicles, determining locations of the surrounding vehicles based on the generated lane information, and selecting recognizable surrounding vehicles based on the locations of the surrounding vehicles.

8 Claims, 9 Drawing Sheets

SYSTEM AND METHOD FOR RECOGNIZING SURROUNDING VEHICLE

CROSS-REFERENCE TO RELATED APPLICATION

This application claims priority to and the benefit of Korean Patent Application No. 2015-0177846, filed on Dec. 14, 2015, the disclosure of which is incorporated herein by reference in its entirety.

BACKGROUND

1. Field of the Invention

The present invention relates to a system and method for recognizing a surrounding vehicle, and more particularly, to a system and method for recognizing a surrounding vehicle based on wireless access for vehicular environment (WAVE).

2. Discussion of Related Art

Recently, in the field of vehicle technology, active research is underway on a surrounding vehicle recognition method and a lane recognition method for reducing accidents.

In general, lane and surrounding vehicle sensing methods are based on images captured by a camera or a sensor installed on a vehicle.

However, with a lane sensing method based on a camera or a sensor, surrounding vehicles may not be sensed properly depending on weather or outside brightness factor. For example, in clear weather, it is possible to easily sense a lane of a road. However, in a dark environment or a poor weather condition such as snow or rain, lanes may not be sensed through a camera or a sensor, or it is possible to sense a lane only within a narrow field of vision. Even under strong sunlight, direct sunlight illumination into a camera or a sensor may prevent lanes from being easily sensed through image capturing.

Therefore, radar or vision sensors are mainly used as sensors of vehicles, but due to limitations of such sensors, extensive research is underway on a method of recognizing surrounding vehicles using WAVE.

A method of recognizing surrounding vehicles according to related art has a problem in that, at an intersection or a curved road section (e.g., a sharply curved road, an S-shaped road, etc.), it is difficult to recognize surrounding vehicles without the shape of a road.

In relation to this, Korean Unexamined Patent Publication No. 10-2012-0024230 (title: System and Method for Vehicle Control for Collision Avoidance on the basis of Vehicular communication systems) discloses a system which is provided in one vehicle and includes a data generator for generating information data including global positioning system (GPS) location coordinates, a travel direction, and current speed of a vehicle, a vehicle-to-vehicle (V2V) communicator for transmitting the information to other surrounding vehicles through V2V communication and receiving information data from the other vehicles, and a collision estimator for estimating a probability of collision between the vehicle and the other vehicles using the transmitted and received information data.

SUMMARY OF THE INVENTION

The present invention is directed to providing a system and method for estimating lane information using path information of a host vehicle and surrounding vehicles, based on wireless access for vehicular environment (WAVE), and efficiently recognizing the surrounding vehicles based on the estimated lane information.

Aspects of the present invention are not limited thereto, and there may be additional aspects.

According to an aspect of the present invention, there is provided a method for a surrounding vehicle recognition system to recognize a surrounding vehicle, the method including: generating a vehicle map showing coordinates of one or more vehicles surrounding a host vehicle with respect to a current location of the host vehicle based on path information of the host vehicle and the surrounding vehicles; generating lane information on the vehicle map based on the current location and radius-of-curvature information of the host vehicle and the path information of the host vehicle and the surrounding vehicles; determining locations of the surrounding vehicles based on the generated lane information; and selecting recognizable surrounding vehicles based on the locations of the surrounding vehicles.

According to another aspect of the present invention, there is provided a surrounding vehicle recognition system for recognizing one or more vehicles surrounding a host vehicle, the surrounding vehicle recognition system including: a communication module configured to exchange data with the surrounding vehicles; a location information receiving module configured to receive location information of the host vehicle; a memory configured to store a program for recognizing the surrounding vehicles; and a processor configured to execute the program. When executing the program, the processor generates a vehicle map showing coordinates of the surrounding vehicles with respect to a current location of the host vehicle based on path information of the host vehicle and the surrounding vehicles, generates lane information on the vehicle map based on the current location and radius-of-curvature information of the host vehicle and the path information of the host vehicle and the surrounding vehicles, determines locations of the surrounding vehicles based on the generated lane information, and selects recognizable surrounding vehicles based on the locations of the surrounding vehicles.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereinafter, exemplary embodiments of the present invention will be described in detail with reference to the accompanying drawings so that those of ordinary skill in the art of the present invention can readily implement the embodiments. However, the present invention can be implemented in a variety of different forms and is not limited to embodiments described herein. In the following description, parts irrelevant to the description will be omitted so that the present invention can be clearly described.

Throughout the specification, when a part is referred to as "including" a component, the part does not exclude another component and may include another component unless defined otherwise.

Figure 1:
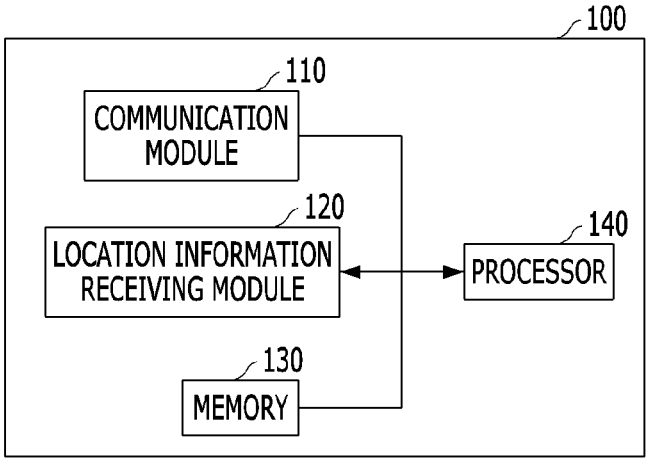
FIG. 1 is a block diagram of a surrounding vehicle recognition system according to an exemplary embodiment of the present invention.

FIG. 1 is a block diagram of a surrounding vehicle recognition system 100 according to an exemplary embodiment of the present invention.

The surrounding vehicle recognition system 100 according to an exemplary embodiment of the present invention recognizes one or more vehicles surrounding the host vehicle. Such a surrounding vehicle recognition system 100 includes a communication module 110, a location information receiving module 120, a memory 130, and a processor 140.

The communication module 110 exchanges data with the surrounding vehicles. Such a communication module 110 may include both a wired communication module and a wireless communication module. The wired communication module may be implemented as a power line communication (PLC) device, a telephone line communication device, a cable home (multimedia over coax alliance (MoCA)) device, an Ethernet device, an Institute of Electrical and Electronics Engineers (IEEE) 1294 device, a wired integrated home network device, and an RS-485 control device. Also, the wireless communication module may be implemented with a technology including wireless local area network (WLAN), Bluetooth, high data rate (HDR) wireless personal area network (WPAN), ultra wideband (UWB), ZigBee, impulse radio, 60-GHz WPAN, binary-code division multiple access (CDMA), wireless universal serial bus (USB), wireless high definition multimedia interface (HDMI), and so on.

In an exemplary embodiment of the present invention, the communication module 110 may receive location information of the host vehicle through an internal vehicle network (IVN) and receive location information of the surrounding vehicles through wireless access for vehicular environment (WAVE).

The location information receiving module 120 receives the location information of the host vehicle. Here, the location information receiving module 120 may be, for example, a global positioning system (GPS). Through the GPS, it is possible to receive location information of the host vehicle, including latitude, longitude, altitude, and so on.

In the memory 130, a program for recognizing surrounding vehicles is stored. Here, the memory 130 denotes a common memory device, such as a non-volatile memory device which continuously maintains stored information without power supplied or a volatile memory device.

For example, the memory 130 may include a NAND flash memory, such as compact flash (CF) card, a secure digital (SD) card, a memory stick, a solid-state drive (SSD), a micro SD card, etc., a magnetic computer storage device, such as a hard disk drive (HDD), etc., an optical disk drive, such as a compact disk read-only memory (CD-ROM), a digital versatile disk (DVD)-ROM, etc., and so on.

Also, the program stored in the memory 130 may be implemented in the form of software or hardware, such as a field programmable gate array (FPGA) or an application specific integrated circuit (ASIC), and perform certain roles.

The processor 140 executes the program stored in the memory 130. When executing the program, the processor 140 generates a vehicle map showing coordinates of surrounding vehicles with respect to the current location of the host vehicle based on path information of the host vehicle and one or more vehicles surrounding the host vehicle.

Here, the path information may be represented in the form of point data (e.g., data of 23 points). Such path information may show different densities of points according to curvature.

After that, the processor 140 generates lane information on the vehicle map based on the current location and radius-of-curvature information of the host vehicle and the path information of the host vehicle and the surrounding vehicles. The processor 140 may find locations of the surrounding vehicles based on the generated lane information and select recognizable surrounding vehicles.

For reference, the components shown in FIG. 1 according to an exemplary embodiment of the present invention may be implemented in the form of software or hardware, such as an FPGA or an ASIC, and perform certain roles.

However, the meaning of "components" is not limited to software or hardware, and each component may be configured to reside in an addressable storage medium and to drive one or more processors.

Therefore, components include, for example, software components, object-oriented software components, class components, task components, processes, functions, attributes, procedures, subroutines, program code segments, drivers, firmware, microcode, circuits, data, databases, data structures, tables, arrays, and variables.

Components and functions provided by the components may be combined into a smaller number of components or subdivided into additional components.

A surrounding vehicle recognition method of the surrounding vehicle recognition system 100 according to an exemplary embodiment of the present invention will be described in detail below with reference to FIGS. 2 to 10.

Figure 2:
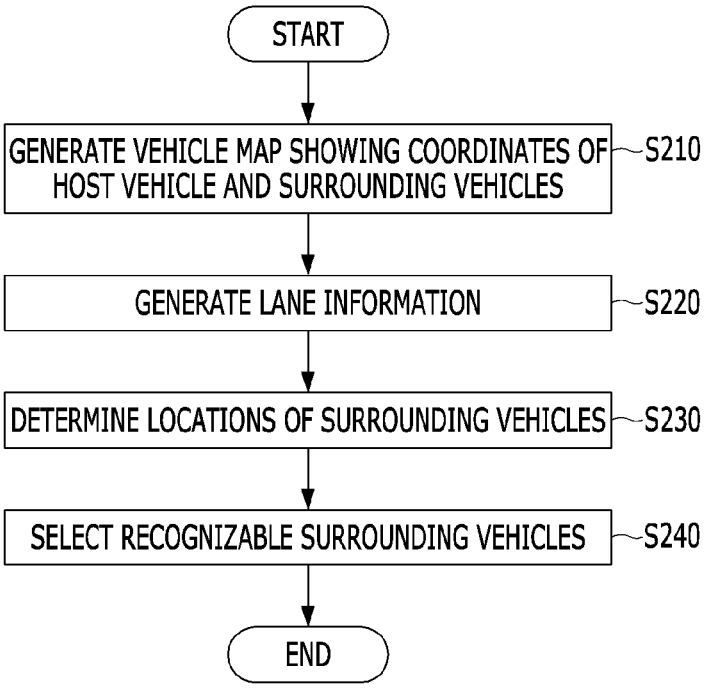
FIG. 2 is a flowchart of a surrounding vehicle recognition method according to an exemplary embodiment of the present invention.

FIG. 2 is a flowchart of a surrounding vehicle recognition method according to an exemplary embodiment of the present invention.

In the surrounding vehicle recognition method according to an exemplary embodiment of the present invention, first, a vehicle map showing coordinates of one or more vehicles surrounding a host vehicle with respect to the current location of the host vehicle is generated based on information of the host vehicle and the surrounding vehicles (S210).

Here, the vehicle map may represent locations and movement of surrounding vehicles within a vehicle to everything (V2X) communication range (about 300 m) of the host vehicle in a relative coordinate system form.

Details for generating such a vehicle map are as follows.

First, longitudes X, latitudes Y, and GPS direction angles ψ of the host vehicle and the surrounding vehicles are converted into a coordinate system (x, y, ϕ) for representing the host vehicle and the surrounding vehicles on a vehicle map as shown in [Equation 1].

$$P_{HV}=[X_0 Y_0 \psi_0]^T$$

$$P_{RV,i}=[X_i Y_i \psi_i]^T$$

$$x_{Local,i}=K_{long}(X_i-X_0)\cos(90-\psi_0)+K_{lat}(Y_i-Y_0)\sin(90-\psi_0)\ K_{long}=11{,}413\ \cos(Y_0)-94\ \cos(3Y_0)$$

$$y_{Local,i}=-K_{long}(X_i-X_0)\sin(90-\psi_0)+K_{lat}(Y_i-Y_0)\cos(90-\psi_0)\ k_{lat}=111{,}133-560\ \cos(2Y_0)$$

$$\phi_{Local,i}=-(\psi_i-\psi_0) \qquad \text{[Equation 1]}$$

Next, path information given as longitudes and latitudes of the surrounding vehicles is converted into coordinates with respect to a basis of the host vehicle as shown in [Equation 2]. Then, each piece of the path information is converted into a point (x, y) to be represented on a vehicle map.

$$P_{HV}=[X_0 Y_0 \psi_0]^T$$

$$P_{PH,i}=[X_{PH,i} Y_{PH,i}]^T$$

$$x_{PH,i}=\cos(90-\psi_0)K_{long}(X_{PH,i}-X_0)+\sin(90-\psi_0)K_{lat}(Y_{PH,i}-Y_0)$$

$$y_{PH,i}=-\sin(90-\psi_0)K_{long}(X_{PH,i}-X_0)+\cos(90-\psi_0)K_{lat}(Y_{PH,i}-Y_0) \qquad \text{[Equation 2]}$$

Here, path information of a surrounding vehicle may be calculated based on a chord length c, an angular difference α, a turning radius R, a center distance d, and a horizontal distance error e as shown in [Equation 3].

$$c=\sqrt{(x-x_0)^2+(y-y_0)^2} \qquad \text{[Equation 3]}$$

$$\alpha=|\psi-\psi_0|$$

$$R=\frac{c}{2}\sin\frac{\alpha}{2}$$

$$d=\frac{c}{2}\tan\frac{\alpha}{2}$$

$$e=R-d$$

Here, the path information may be used only when the horizontal distance error e and the chord length c exceed preset threshold values while the surrounding vehicle is traveling.

After the vehicle map is generated through the above process, lane information is generated on the vehicle map based on the current location and radius-of-curvature information of the host vehicle and path information of the host vehicle and the surrounding vehicles (S220).

In other words, it is possible to estimate a travel line abstracted with respect to the host vehicle based on the current location and the radius-of-curvature information of the host vehicle and the path information of the host vehicle and the surrounding vehicles. Here, the estimated lane information may be expressed in the form of a parameterized cubic function.

Such lane information is intended to select path information of surrounding vehicles ahead to be used to accurately estimate a lane in which the host vehicle currently travels. Here, the surrounding vehicles ahead may be assumed not to switch lanes during traveling.

A method of generating such lane information will be described with reference to FIG. 3 to FIG. 5C and FIG. 9.

Figure 3:
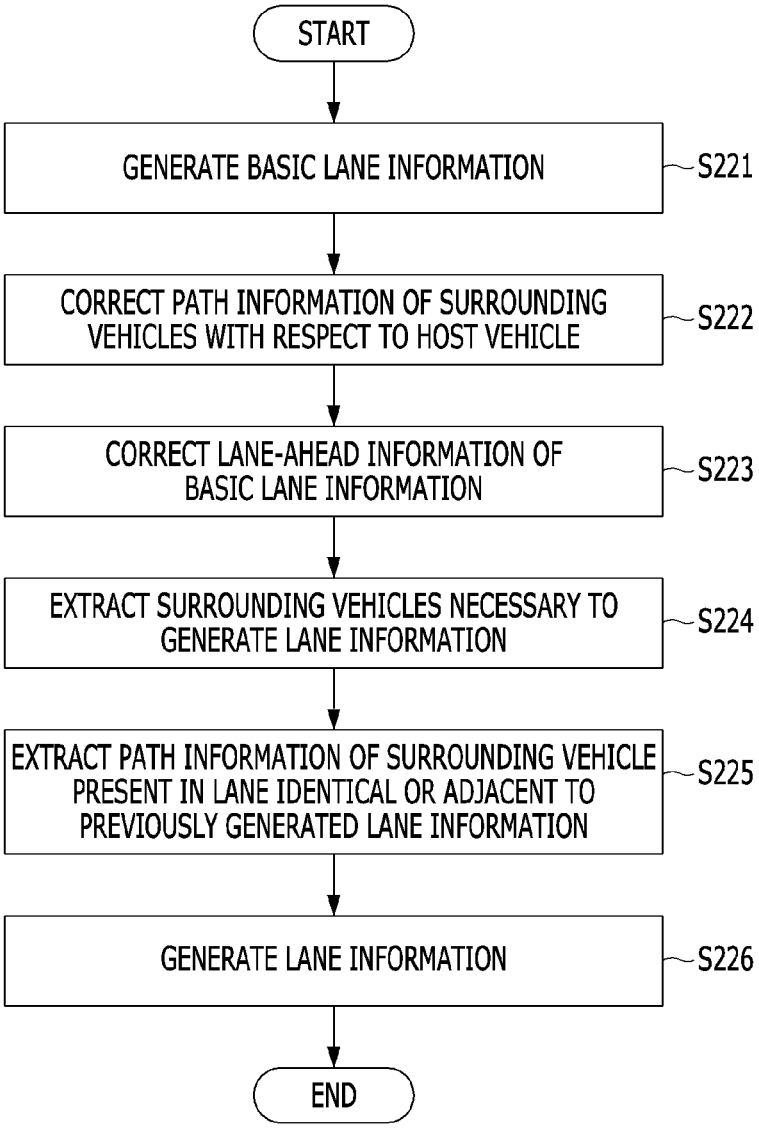
FIG. 3 is a flowchart of a lane information generation operation.
Figure 5A:
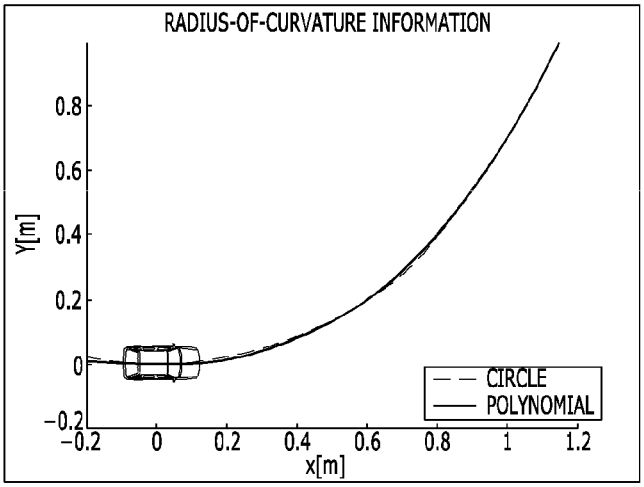
FIG. 5A to FIG. 5C shows diagrams illustrating lane-ahead information of basic lane information.
Figure 5B:
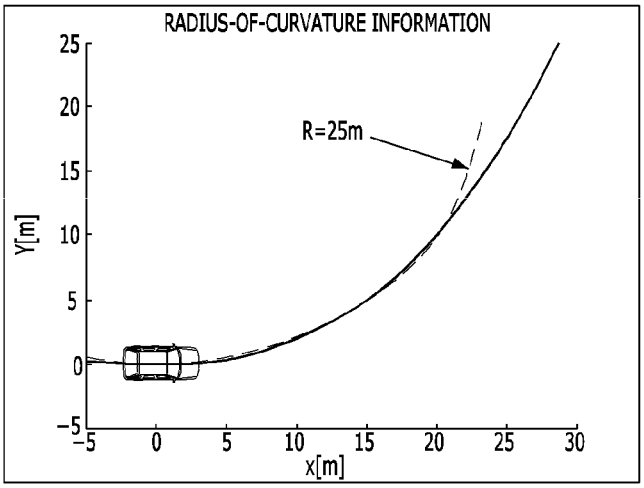
Figure 5C:
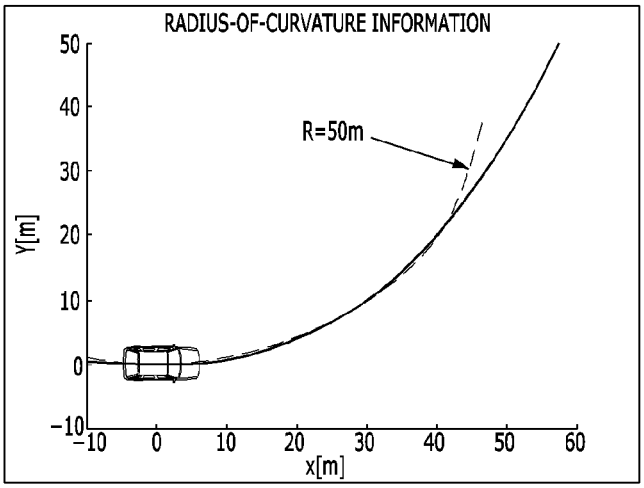
Figure 6:
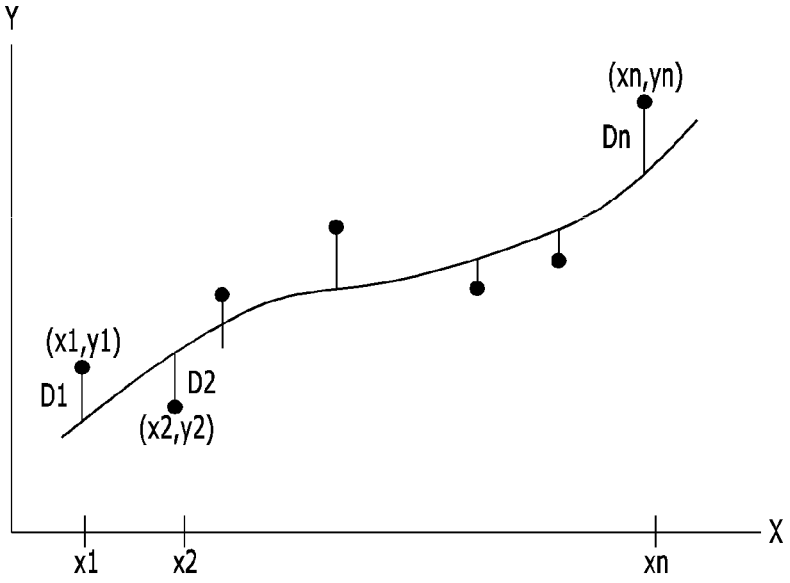
FIG. 6 is a diagram illustrating lane-behind information of basic lane information.
Figure 7:
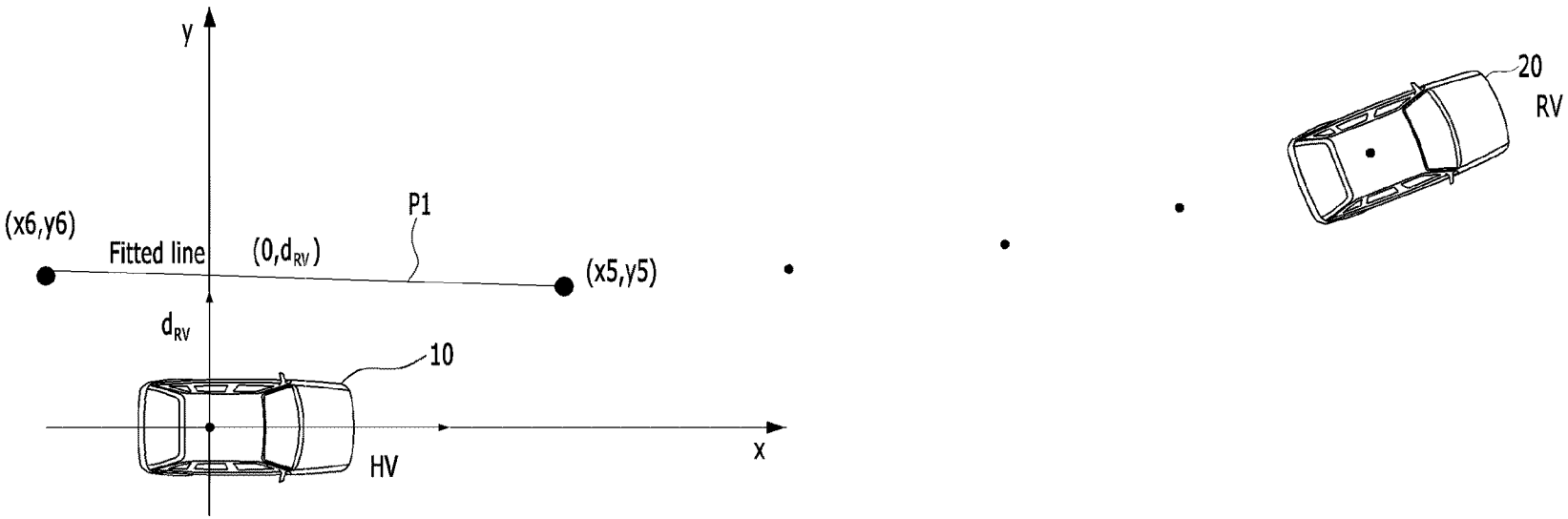
FIG. 7, FIG. 8A and FIG. 8B are diagrams illustrating an operation of correcting lane-ahead information.
Figure 8A:
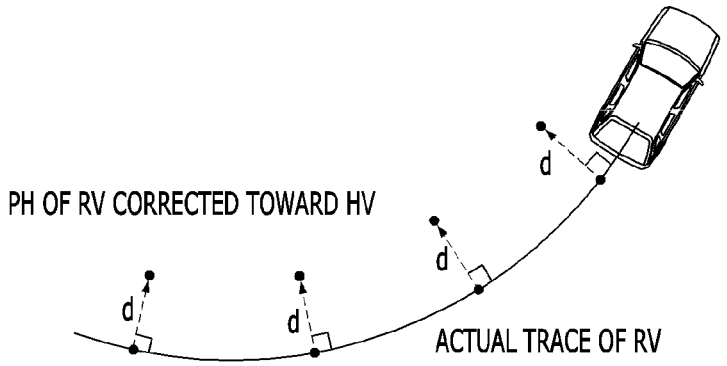
Figure 8B:
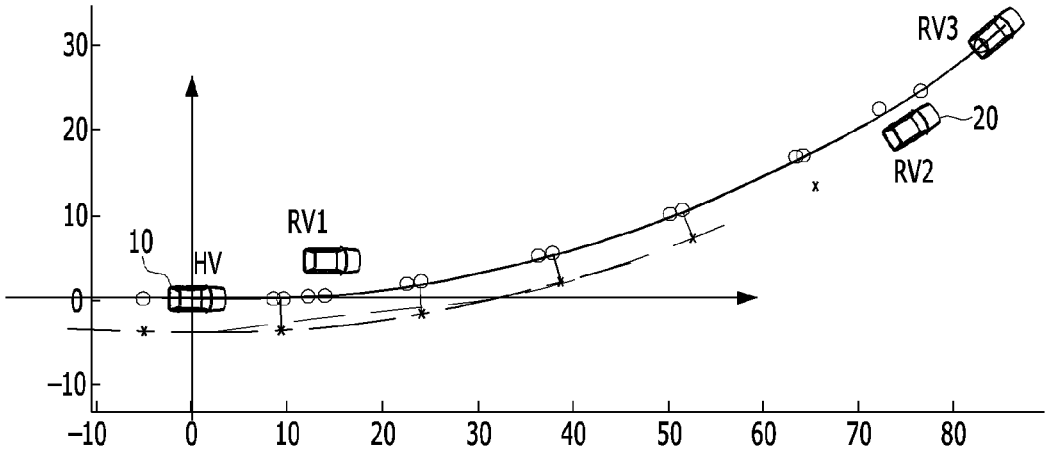
Figure 9:
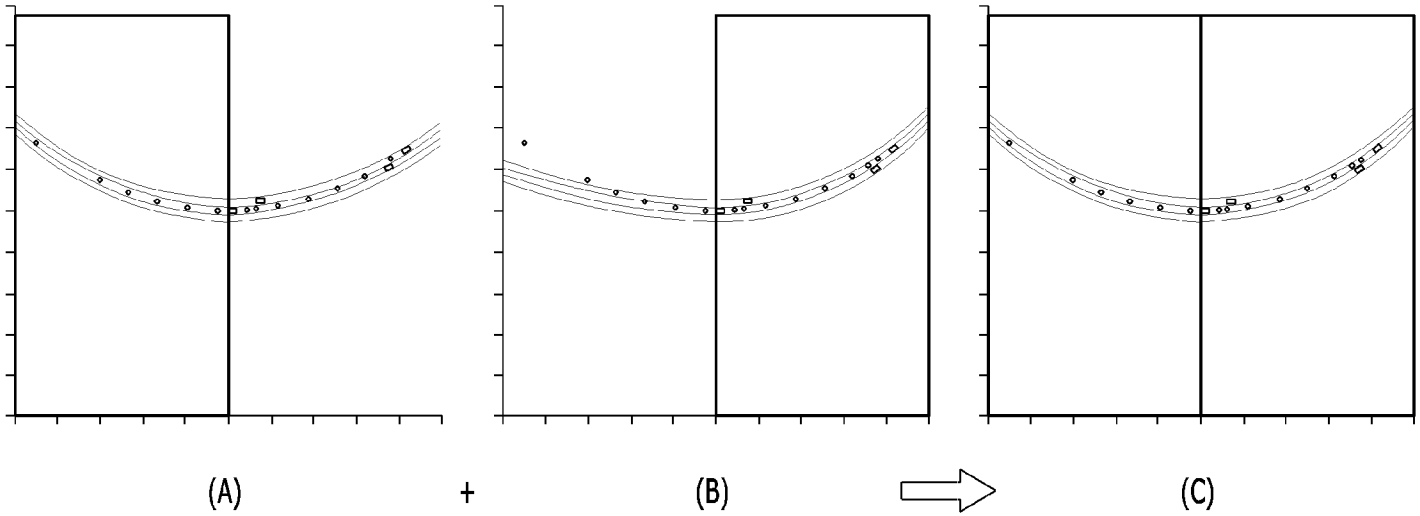
FIG. 9 shows diagrams illustrating an operation of correcting basic lane information.

FIG. 3 is a flowchart of a lane information generation operation. FIG. 5A to FIG. 5C shows diagrams illustrating lane-ahead information of basic lane information. FIG. 6 is a diagram illustrating lane-behind information of basic lane information. FIG. 7 to FIG. 8B are diagrams illustrating an operation of correcting lane-ahead information. FIG. 9 shows diagrams illustrating an operation of correcting basic lane information.

In the operation of generating lane information, first, basic lane information is generated based on the path information of the host vehicle (S221).

The basic lane information is lane information generated with information on the host vehicle alone assuming that there is no surrounding vehicle in front of the host vehicle. Here, the basic lane information includes lane-ahead information and lane-behind information.

The lane-ahead information may be generated based on radius-of-curvature information of the host vehicle. Assuming that the host vehicle turns with a fixed turning radius, the forward path may be a circular shape. To simulate such a circular shape, a cubic curve in accordance with Equation 4 below may be generated.

$$y=\frac{0.351}{R^2}x^3+\frac{0.351}{R}x^2 \qquad \text{[Equation 4]}$$

A case in which the host vehicle moves by 60 degrees along the generated cubic curve is shown as a graph in FIG. 5A to FIG. 5C.

FIG. 5A shows a case in which a radius of curvature R is 1 m. When a radius of curvature is 1 m, it is possible to see that a cubic curve almost corresponds to a circle. However, when slope increases, a cubic curve deviates from a complete circle due to characteristics of the cubic curve. Therefore, when the host vehicle moves by 60 degrees or more, an error may occur.

FIG. 5B and FIG. 5C show a case in which a radius of curvature is 25 m and a case in which a radius of curvature is 50 m, respectively. It is possible to see that there is an error between a circle and a cubic curve when the host vehicle turns by 60 degrees or more, whereas a circle and a cubic curve almost correspond to each other at less than 60 degrees. Also, when radii of curvature are 25 m and 50 m, it is possible to see that the cubic curves are identical to each other in shape and increase in size only.

In this way, lane-ahead information may be modeled using Equation 4 and radius-of-curvature information of a vehicle.

Lane-behind information may be modeled using the least square method. To generate lane-behind information, it is necessary to extract a cubic curve for minimizing distance of each sample point D shown in FIG. 6.

When a cubic curve formula is applied to all sample points D, the results may be expressed in the form of a matrix as shown in Equation 5 below.

$$\begin{aligned} ax_1^3+bx_1^2+cx_1+d&=y_1\\ ax_2^3+bx_2^2+cx_2+d&=y_2\\ &\vdots\\ ax_n^3+bx_n^2+cx_n+d&=y_n \end{aligned} \rightarrow \qquad \text{[Equation 5]}$$

$$\begin{bmatrix} x_1^3 & x_1^2 & x_1 & 1\\ x_2^3 & x_2^2 & x_2 & 1\\ \vdots & \vdots & \vdots & \vdots\\ x_n^3 & x_n^2 & x_n & 1 \end{bmatrix}\begin{bmatrix} a\\ b\\ c\\ d \end{bmatrix}=\begin{bmatrix} y_1\\ y_2\\ \vdots\\ y_n \end{bmatrix} \rightarrow V\cdot p=y$$

Here, since V is not a square matrix, it is possible to produce $p=(V^TV)^{-1}V^Ty$ using a pseudo inverse matrix.

Meanwhile, when the number of sample points D is 5 or more, it is possible to use a matrix shown in Equation 6 below.

$$\begin{matrix} ax_1^3+bx_1^2=y_1 \\ ax_2^3+bx_2^2=y_2 \\ \downarrow \\ ax_n^3+bx_n^2=y_n \end{matrix} \rightarrow \begin{bmatrix} x_1^3 & x_1^2 \\ x_2^3 & x_2^2 \\ \vdots & \vdots \\ x_n^3 & x_n^2 \end{bmatrix} \begin{bmatrix} a \\ b \end{bmatrix} = \begin{bmatrix} y_1 \\ y_2 \\ \vdots \\ y_n \end{bmatrix} V \cdot p = y \quad \text{[Equation 6]}$$

On the other hand, when number of sample points D is less than 5, it is possible to use a matrix shown in Equation 7 below.

$$\begin{matrix} bx_1^2+cx_1+d=y_1 \\ bx_2^2+cx_2+d=y_2 \\ \vdots \\ bx_n^2+cx_n+d=y_n \end{matrix} \rightarrow \begin{bmatrix} x_1^2 & x_1 & 1 \\ x_2^2 & x_2 & 1 \\ \vdots & \vdots & \vdots \\ x_n^2 & x_n & 1 \end{bmatrix} \begin{bmatrix} b \\ c \\ d \end{bmatrix} = \begin{bmatrix} y_1 \\ y_2 \\ \vdots \\ y_n \end{bmatrix} \rightarrow V \cdot p = y \quad \text{[Equation 7]}$$

As described above, basic lane information may be represented in the form of a cubic function and may also be represented as a quadratic curve according to the number of sample points.

Referring back to FIG. 3, after the basic lane information is generated, path information of one or more surrounding vehicles in front of the host vehicle is corrected with respect to the host vehicle based on lateral distance information of the surrounding vehicles (S222).

At this time, to correct the information of the surrounding vehicles, it is necessary for the host vehicle and the surrounding vehicle to be traveling on the same road. In other words, only when the path information of the surrounding vehicle covers the rear of the host vehicle and there is sufficient information to estimate a road shape, is it possible to determine that the host vehicle and the surrounding vehicles travel on the same road.

Meanwhile, since it is assumed that a host vehicle 10 travels on a road similar to a road through which a surrounding vehicle 20 have passed, it is possible to produce a first-degree polynomial shown in Equation 8 using two pieces of path information (x5, y5) and (x6, y6) which are closest to the path information of the surrounding vehicle 20, as shown in FIG. 7.

$$d_{RV} = y_5 - \frac{y_6 - y_5}{x_6 - x_5} \times x_5 \quad \text{[Equation 8]}$$

When a lateral distance error $d_{RV}$ between a curve and the host vehicle according to Equation 8 is calculated in this way, it is possible to correct the path information of the surrounding vehicle 20 in front of the host vehicle 10. In other words, as shown in FIG. 8A and FIG. 8B, each piece of the path information of the surrounding vehicle 20 is moved toward the host vehicle 10 by the lateral distance error $d_{RV}$ calculated based on the path information of the surrounding vehicle 20.

Referring back to FIG. 3, after the path information of the surrounding vehicles is corrected, lane-ahead information of the basic lane information is corrected based on the corrected information of the surrounding vehicles (S223). In other words, by combining lane-behind information in (A) of FIG. 9, which is an estimation result based on only the path information of the host vehicle, and lane-ahead information in (B) of FIG. 9, which is an estimation result based on only the path information of the surrounding vehicles in front of the host vehicle, a final correction is made to the basic lane information in (C) of FIG. 9.

Referring to FIG. 3, after the basic lane information is corrected in this way, surrounding vehicles necessary for lane information are extracted from among the surrounding vehicles included in the corrected basic lane information (S224). In other words, using the location information and the path information of the surrounding vehicles and lane information generated in a previous process, surrounding vehicles which are not necessary for generating lane information are filtered and removed.

At this time, surrounding vehicles may be extracted in consideration of a preset maximum number of recognizable surrounding vehicles, and the maximum number of recognizable surrounding vehicles may be set in consideration of the amount of computation. Based on lane information which is estimated through such a process, it is possible to update recognizable surrounding vehicles.

Meanwhile, when the number of recognizable surrounding vehicles is less than a preset minimum value, since there is a small number of surrounding vehicles necessary to generate lane information, the surrounding vehicles which are determined to be unnecessary for generating lane information are not removed. From the path information of the surrounding vehicles that have not been removed, path information before a lane change may be extracted and used to generate lane information.

When surrounding vehicles necessary to generate lane information are extracted in this way, path information of a surrounding vehicle present in a lane which is identical or adjacent to previously generated lane information among the extracted surrounding vehicles is extracted (S225). In other words, path information which does not belong to a valid area of the lane information generated in the previous process is filtered and removed from the path information of the surrounding vehicles extracted to generate lane information.

Next, lane information may be generated on the vehicle map based on the extracted path information of the surrounding vehicle (S226).

Referring back to FIG. 2, after the lane information is generated in this way, locations of the surrounding vehicles are determined based on the generated lane information (S230).

The locations of the surrounding vehicles may be determined based on the generated lane information and used to classify surrounding vehicles which will be used later to estimate a lane. When the locations of the surrounding vehicles are determined, it is possible to obtain longitudinal/latitudinal direction information of the surrounding vehicles recognized based on the lane information, information on the difference in direction between the lane information and the recognized surrounding vehicles, and so on.

Such a surrounding vehicle location determination operation will be described with reference to FIGS. 4 and 10.

Figure 4:
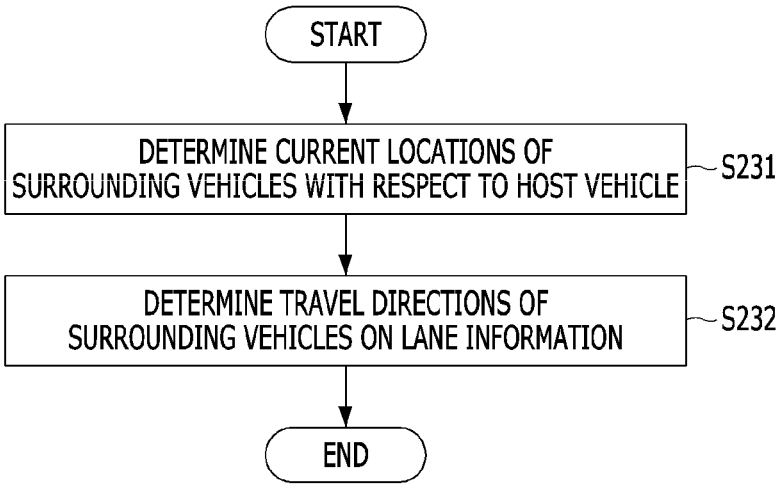
FIG. 4 is a flowchart of a surrounding vehicle location determination operation.

FIG. 4 is a flowchart of a surrounding vehicle location determination operation. FIG. 10 is a diagram illustrating an operation of selecting recognizable surrounding vehicles.

In the operation of determining locations of surrounding vehicles, first, current locations of the surrounding vehicles are determined with respect to the host vehicle based on a width of the generated lane information and widths of the surrounding vehicles (S231). At this time, the current locations of the surrounding vehicles may be classified into front, left, right, far left, and far right with respect to the host vehicle.

Next, travel directions of the surrounding vehicles on the lane information are determined based on travel directions of the surrounding vehicles and a travel direction of the lane information (S232). At this time, the travel directions of the surrounding vehicles may be classified into forward, backward, and cross.

Meanwhile, according to an exemplary embodiment of the present invention, it is possible to determine whether or not a surrounding vehicle is a vehicle going through an intersection based on the host vehicle.

To determine whether or not a surrounding vehicle is cross traffic, first, it is determined whether or not a difference in travel directions of the generated lane information and the surrounding vehicle exceeds a preset threshold value for a fixed time. When it is determined that the difference exceeds the preset threshold value, it is possible to determine that the surrounding vehicle is a vehicle going through an intersection.

At this time, by making such determinations for only surrounding vehicles which are at 15 degrees or more from the host vehicle among vehicles whose current locations are classified as far left or far right, it is possible to further increase accuracy in determining whether or not surrounding vehicles are cross traffic.

Also, according to an exemplary embodiment of the present invention, it is possible to determine whether or not a surrounding vehicle has switched lanes during traveling, with respect to the host vehicle.

To determine whether or not a surrounding vehicle has switched lanes during traveling, first, it is determined whether or not differences in travel directions of the host vehicle and the surrounding vehicles present in all directions of the host vehicle exceed a preset threshold value. When the difference exceeds the preset threshold value, the corresponding surrounding vehicle may be determined to be a surrounding vehicle which has switched lanes during traveling.

Figure 10:
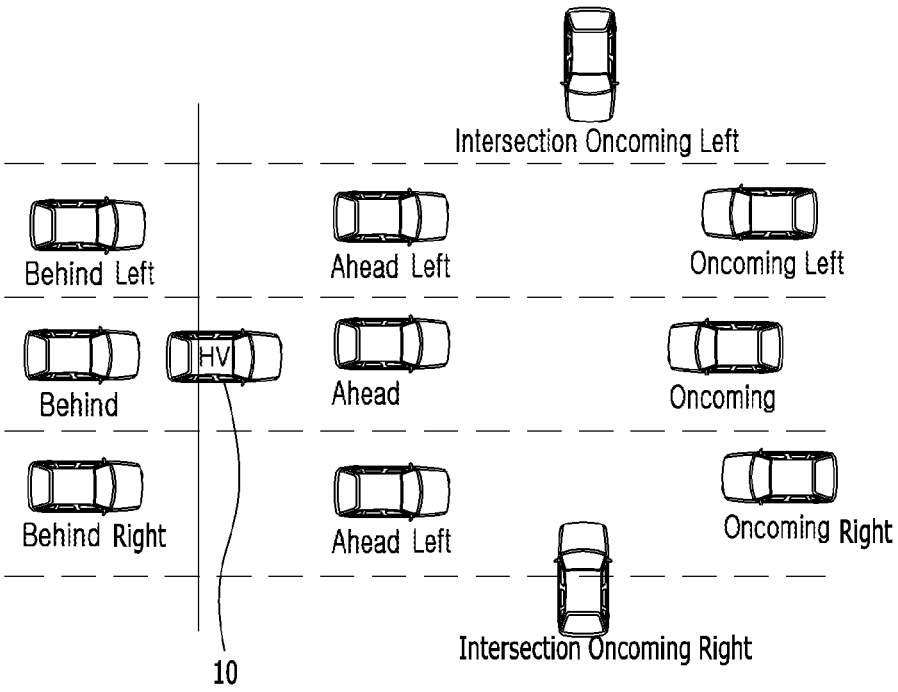
FIG. 10 is a diagram illustrating an operation of selecting recognizable surrounding vehicles.

Such locations of surrounding vehicles may be classified as shown in FIG. 10. In other words, travel directions may be classified into 11 kinds according to front, back, left, and right sides of the host vehicle 10, depending on where the surrounding vehicles are located and travel directions of forward, backward, and cross traffic, depending on the travel directions of the surrounding vehicles.

Referring back to FIG. 2, after the locations of the surrounding vehicles are determined, recognizable surrounding vehicles are selected based on the locations of the surrounding vehicles (S240).

According to an exemplary embodiment of the present invention, an operation of generating a surrounding vehicle information table including information of the recognizable surrounding vehicles may be further included. In other words, when information of the recognizable surrounding vehicles is generated based on the locations of the surrounding vehicles, the generated information may be stored and updated in the surrounding vehicle information table in the form of flags. Such a surrounding vehicle information table may be updated during every execution operation.

The surrounding vehicle information table may store the information of the surrounding vehicles for a preset time and then removes the stored information. For example, the surrounding vehicle information table may store the information of the recognizable surrounding vehicles for a preset time (500 ms) and, when the time (500 ms) elapses, then remove the stored surrounding vehicle information.

The information of the surrounding vehicles stored in such a surrounding vehicle information table may be used to generate lane information and may also be used to generate lane information in the next execution operation after it is determined whether or not the surrounding vehicles have switched lanes. Here, to generate lane information, only information of vehicles whose locations are classified as ahead, ahead right, and ahead left may be used as surrounding vehicle information.

In the above description, operations S210 to S240 may be subdivided into additional operations or combined into a smaller number of operations according to implementation of the present invention. Also, some operations may be omitted as necessary, and a sequence of operations may be changed. Further, although omitted here, the above descriptions of FIG. 1 may be applied to the surrounding vehicle recognition method of FIGS. 2 to 4.

According to any one of exemplary embodiments of the present invention, surrounding vehicles are recognized through WAVE, and thus it is possible to surpass the limitations of existing driver-assistance system (DAS) sensors.

Also, since an exemplary embodiment of the present invention can be implemented by installing software in a vehicle equipped with a V2X terminal, additional hardware is not necessary.

Meanwhile, the surrounding vehicle recognition method according to an exemplary embodiment of the present invention may also be implemented in the form of a computer program stored in a medium executed by a computer or a recording medium including computer-executable instructions. The computer-readable medium may be any available media that are accessed by a computer and includes volatile and non-volatile media and removable and non-removable media. Also, the computer-readable medium may include both computer storage media and communication media. The computer storage media include volatile and non-volatile media and removable and non-removable media which are realized in any method or technique for storing information, such as computer-readable instructions, data structures, program modules, or other data. The communication media typically include computer-readable instructions, data structures, program modules, other data of modulated data signals, such as carrier waves, or other transmission mechanisms, and include any information transfer media.

Although particular embodiments of the present invention have been described above, components or some or all operations thereof may be implemented by a computer system having a general-use hardware architecture.

The above description of the present invention is exemplary, and those of ordinary skill in the art will appreciate that the present invention can be easily carried out in other detailed forms without changing the technical spirit or essential characteristics of the present invention. Therefore, it should be noted that the exemplary embodiments described above are exemplary in all aspects and are not restrictive. For example, each component described to be a single type can be implemented in a distributed manner. Likewise, components described to be distributed can be implemented in a combined manner.

In is also noted that the scope of the present invention is defined by the claims rather than the description of the present invention, and the meanings and ranges of the claims and all modifications derived from the concept of equivalents fall within the scope of the present invention.

What is claimed is:

1. A method of communicating with adjacent vehicles and processing for recognizing one or more adjacent vehicles to reduce accidents, the method comprising:

providing a vehicle recognition system of a host vehicle, the system comprising a communication module configured to wireless communicate with adjacent vehicles via wireless access for vehicular environment (WAVE), a memory configured to store a program for recognizing one or more of the surrounding vehicles, and a processor configured to execute the program;

obtaining, by the vehicle recognition system, path information of the adjacent vehicles by wirelessly communicating with the adjacent vehicles while the host vehicle is traveling, generating, by the vehicle recognition system, a vehicle map showing one or more vehicles surrounding the host vehicle with respect to a current location of the host vehicle based on path information of the host vehicle and the adjacent vehicles;

generating, by the vehicle recognition system, land information on the vehicle map based on the current location and radius-of-curvature information of the host vehicle and the path information of the host vehicle and the adjacent vehicles;

determining, by the vehicle recognition system, locations of the adjacent vehicles based on the generated lane information;

selecting, by the vehicle recognition system, recognizable adjacent vehicles based on the locations of the adjacent vehicles; and wherein determining the locations of the adjacent vehicles includes:

determining current locations of the adjacent vehicles with respect to the host vehicle based on a width of the generated lane information and widths of the adjacent vehicles; and determining travel directions of the adjacent vehicles on the lane information based on travel directions of the adjacent vehicles and of the generated lane information;

wherein the determining of the travel directions of the adjacent vehicles includes:

determining whether or not differences in travel directions of the generated lane information and adjacent vehicles exceed a preset threshold value for a predetermined time; and when it is determined that a difference exceeds the preset threshold value, determining that a corresponding adjacent vehicle is an adjacent vehicle going through an intersection.

2. The method of claim 1, wherein the generating of the lane information includes:

generating basic lane information based on the path information of the host vehicle;

correcting the path information of the surrounding vehicles with respect to the host vehicle based on lateral distance information of one or more surrounding vehicles in front of the host vehicle; and correcting lane-ahead information of the basic lane information based on the corrected path information of the surrounding vehicles.

3. The method of claim 2, wherein the generating of the lane information further includes:

extracting surrounding vehicles necessary to generate the lane information from the surrounding vehicles present in the corrected basic lane information;

extracting path information of a surrounding vehicle present in a lane identical or adjacent to previously generated lane information, among the extracted surrounding vehicles; and generating the lane information on the vehicle map based on the extracted path information of the surrounding vehicle.

4. The method of claim 3, wherein the extracting of the surrounding vehicles necessary to generate the lane information includes:

extracting the surrounding vehicles based on a preset maximum number of recognizable surrounding vehicles; and updating the recognizable surrounding vehicles based on the generated lane information.

5. The method of claim 3, wherein the extracting of the surrounding vehicles necessary to generate the lane information includes, when a number of the recognizable surrounding vehicles is less than a preset minimum value, leaving, as they are, surrounding vehicles determined as unnecessary for generating the lane information, and wherein the extracting of the path information of the surrounding vehicle includes extracting path information up to a lane change from path information of the surrounding vehicles.

6. The method of claim 1, wherein the determining of the travel directions of the surrounding vehicles further includes:

determining whether or not differences in travel directions of the host vehicle and the surrounding vehicles present in all directions of the host vehicle exceed a preset threshold value; and when it is determined that a difference exceeds the preset threshold value, determining that a corresponding surrounding vehicle has switched lanes.

7. The method of claim 1, further comprising, generating a surrounding vehicle information table including information of the recognizable surrounding vehicles, wherein, in the surrounding vehicle information table, information of the recognizable surrounding vehicles selected based on the locations of the surrounding vehicles is updated.

8. The method of claim 7, wherein the surrounding vehicle information table stores the information of the recognizable surrounding vehicles for a preset time and then removes the information.

* * * * *